US009526972B2

(12) United States Patent
Steinke et al.

(10) Patent No.: US 9,526,972 B2
(45) Date of Patent: Dec. 27, 2016

(54) FRONT UNIT FOR A SKI BINDING AND SYSTEM CONSISTING OF A FRONT UNIT AND A REAR UNIT

(71) Applicant: Markus Steinke, Ascholding/Dietramszell (DE)

(72) Inventors: Markus Steinke, Ascholding/Dietramszell (DE); Michael Kreuzinger, Munich (DE); Ulrich Schwingshackl, Eppan an der Weinstraβe (IT); Lukas Jungmann, Tristach (AU)

(73) Assignee: Markus Steinke, Ascholding (DE)

( * ) Notice: Subject to any disclaimer, the term of this patent is extended or adjusted under 35 U.S.C. 154(b) by 0 days.

(21) Appl. No.: 14/831,362

(22) Filed: Aug. 20, 2015

(65) Prior Publication Data

US 2016/0074742 A1 Mar. 17, 2016

(30) Foreign Application Priority Data

Aug. 20, 2014 (DE) ..... 10 2014 111 934

(51) Int. Cl.
*A63C 9/20* (2012.01)
*A63C 9/00* (2012.01)
(Continued)

(52) U.S. Cl.
CPC ..... *A63C 9/20* (2013.01); *A63C 9/006* (2013.01); *A63C 9/02* (2013.01); *A63C 9/086* (2013.01);
(Continued)

(58) Field of Classification Search
CPC ..... A63C 9/20; A63C 9/006; A63C 9/02; A63C 9/0807; A63C 9/08507; A63C 9/08521; A63C 9/086; A63C 2009/008
(Continued)

(56) References Cited

U.S. PATENT DOCUMENTS 8,544,869 B2 * 10/2013 Lehner ..... A63C 9/0807 280/611
9,016,712 B2 * 4/2015 Giordani ..... A63C 9/006 280/614
(Continued)

FOREIGN PATENT DOCUMENTS

AT 12706 U1 10/2012
DE 69603222 T2 3/2000
(Continued)

OTHER PUBLICATIONS

European Search Report for EP 15181703.8 dated Oct. 29, 2015.
German Office Action issued Mar. 24, 2015 for German patent application serial No. 102014111934.7 and translation.

*Primary Examiner* — John Walters
(74) *Attorney, Agent, or Firm* — McCarter & English, LLP; David R. Burns

(57) ABSTRACT

The present invention relates to a front unit for a ski binding, comprising a front jaw for fixating a ski boot in a downhill position and engagement members for pivotably supporting the ski boot about a horizontal pivot axis perpendicular to the longitudinal axis of the ski in a climbing position, wherein for switching between the downhill position and the climbing position the front jaw is disposed slidably in the direction of the longitudinal axis of the ski relative to the engagement members.

12 Claims, 7 Drawing Sheets

(51) Int. Cl.

| | |
|---|---|
| ***A63C 9/08*** | (2012.01) |
| ***A63C 9/085*** | (2012.01) |
| ***A63C 9/086*** | (2012.01) |
| ***A63C 9/02*** | (2012.01) |

(52) U.S. Cl.
CPC ..... *A63C 9/0807* (2013.01); *A63C 9/08521* (2013.01); *A63C 2009/008* (2013.01)

(58) Field of Classification Search
USPC ..... 280/614
See application file for complete search history.

(56) References Cited

U.S. PATENT DOCUMENTS

| | | | | |
|---|---|---|---|---|
| 9,039,031 | B2 * | 5/2015 | Soldan ..... | A63C 9/0807 280/607 |
| 2008/0309053 | A1 | 12/2008 | Mangold et al. | |
| 2011/0049821 | A1 | 3/2011 | Trabucchi et al. | |
| 2013/0056960 | A1 | 3/2013 | Chickering-Ayers | |
| 2013/0207356 | A1 | 8/2013 | Barthel et al. | |
| 2013/0214513 | A1 | 8/2013 | Barthel et al. | |
| 2014/0021696 | A1 | 1/2014 | Soldan et al. | |

FOREIGN PATENT DOCUMENTS

| | | | |
|---|---|---|---|
| DE | 102012201812 | A1 | 8/2013 |
| DE | 102012201816 | A1 | 8/2013 |
| EP | 0199098 | A2 | 10/1986 |
| EP | 2281614 | A1 | 2/2011 |
| EP | 2535092 | A2 | 12/2012 |
| EP | 2620188 | A2 | 7/2013 |
| EP | 2656884 | A1 | 10/2013 |
| EP | 2687275 | A1 | 1/2014 |
| EP | 2813268 | A1 | 12/2014 |
| FR | 2172925 | A1 | 10/1973 |
| FR | 2567409 | A1 | 2/1984 |
| FR | 2567409 | A1 | 1/1986 |

* cited by examiner

B-B

D-D

FRONT UNIT FOR A SKI BINDING AND SYSTEM CONSISTING OF A FRONT UNIT AND A REAR UNIT

TECHNICAL FIELD

The present invention relates to a front unit for a ski binding, comprising a front jaw for fixing a ski boot in a downhill position and engagement members for a pivotable bearing of the ski boot about a horizontal pivot axis perpendicular to the longitudinal axis of the ski in the climbing position, and a system comprising a front unit and a rear unit.

BACKGROUND

Compared to ordinary ski bindings ski bindings for touring skis primarily can be distinguished by the fact that they can be switched between a downhill position and a climbing position. In the climbing position only the front portion of the ski boot is fixed to the ski so that the rear portion of the ski boot can be lifted from the ski and set down on the ski. The front portion of the ski boot rotates about a horizontal axis perpendicular to the longitudinal axis of the ski. In the downhill position both the front portion and the rear portion of the ski boot firmly are fixed to the ski.

Normally, the downhill performance of a touring ski is limited by the necessity of the provision of a climbing function. Hence, known touring binding systems have a higher stand height compared to pure downhill binding systems. Further, the components needed for the climbing position require a comparatively higher cost of materials which leads to a higher weight of the touring bidings.

The conventional touring binding systems can be divided into bridge binding systems and pin systems. The bridge binding systems are remarkable for the fact that the ski boot both in the downhill position and in the climbing position is clamped between the front jaw and the rear jaw. The front jaw and the rear jaw are affixed on a bridge, wherein the front section of the bridge both in the climbing position and the downhill position is fixed to the ski. In the climbing position the front section of the bridge can rotate about a horizontal axis proceeding perpendicular to the longitudinal axis of the ski. The rear end can be fixed to the ski in the downhill position and can be lifted from the ski in the climbing position.

The bridge causes the disadvantages of a higher stand height and a higher weight as already mentioned above. Further, the fact that in the climbing position the rotation does not take place about the front portion of the ski boot but about the front section of the bridge in total leads to a worse pivot point, which adversely affects the walking comfort. Furthermore, due to different shoe sizes different bridge sizes are necessary.

In terms of the pin systems the bindings can be divided into a front unit and a back unit. In the climbing position the ski boot is pivoted about a horizontal pivot axis extending perpendicular to the longitudinal axis of the ski merely by the front unit. The pin systems known from the prior art have the significant disadvantage that they do not fulfil the demands of standardized safety bindings. In particular, a lateral release behavior that allows the ski boot to laterally release itself out of the binding during an increased effect of force in the climbing mode is not feasible with this kind of system. Further, the known pin systems excel by a laborious handling when switching from the downhill position to the climbing position.

SUMMARY

Originating from the known prior art it is an object of the present invention to provide an improved front unit for a ski binding.

This object is solved by means of a front unit with the features of claim 1. The dependent claims reveal advantageous embodiments. Accordingly, a front unit for a ski binding is provided, which comprises a front jaw for the fixation of a ski boot in a downhill position, and engagement members for a pivotable bearing of the ski boot about a horizontal pivot axis perpendicular to a longitudinal axis of the ski in the climbing position. According to the invention the front jaw is slidably disposed in the direction of the longitudinal axis of the ski relative to the engagement members in order to switch between the downhill positon and the climbing position.

Thus, it is possible that the position of the ski boot in terms of the longitudinal axis of the ski and in terms of the height direction is almost identical when switching between the downhill position and the climbing position. Hence, the ski boot in the downhill position on a front portion is fixed via a front jaw to the ski and on a rear portion is fixed via a rear jaw to the ski. When switching into the climbing position the front jaw is moved along the longitudinal axis of the ski towards a tip of the ski, so that the fixation of the ski boot is raised via the front jaw. Further, the engagement members are engaged with the ski boot in the climbing position and pivotably support the ski boot about the pivot axis.

Thus, it is possible that the height on which the front jaw and the engagement members fixate or pivotably support the ski boot in the downhill position or the climbing position, respectively, is the same. This advantageously affects the riding comfort or the climbing comfort, as for the user there is no noticeable difference between the downhill position and the climbing position in terms of the center of gravity. Hence, when the ski binding is in the climbing position the handling of the ski during running down a short downhill passage is quite similar to the handling in the downhill position.

Further, it is not necessary that the user lifts the ski boot when switching between the downhill position and the climbing position which is advantageous especially in difficult terrain.

In the direction of the longitudinal axis of the ski the difference between the climbing position and the downhill position of the ski boot is in a rage of 0 to 10 mm. Thus, in the climbing position the ski boot is offset toward the ski tip by this amount, so that the ski boot does not engage with the rear jaw and thus can be lifted and lowered relatively to the ski. Alternatively, a rear unit can be designed in a way that it can be folded away or shifted backwards. Thus, the position of the ski boot also in the longitudinal direction of the ski does not have to be changed anymore in order to switch between the downhill position and the climbing position.

For fixating the ski boot in the downhill position conventional front jaw systems are suitable which provide a lateral release behavior in case of falling.

In a preferred embodiment each of the engagement members are disposed on a first end of two guiding arms opposing each other, wherein the guiding arms substantially extend in the direction of the longitudinal axis of the ski and wherein each of the guiding arms are guided by a front jaw member of the front jaw.

Thus, also in the climbing position a force originating from the ski boot is received by the front jaw indirectly. Thereby, the engagement members in the climbing position are engaged with the ski boot and transmit forces which pass between the ski boot and the ski via the guiding arms and the front jaw. Thus, especially horizontal shear forces which act on the ski or the ski boot when the binding is in the climbing position can lead to a lateral release of the front jaw via the guiding arms.

The position of the guiding arms and, thus, the position of the engagement members in a horizontal plane transverse to the longitudinal axis of the ski is defined by the front jaw. The front jaw comprises two front jaw members wherein one front jaw member is disposed left of the longitudinal axis of the ski and another front jaw member is disposed right of the longitudinal axis of the ski. In terms of the longitudinal axis of the ski the front jaw members can be deflected laterally or can release independently from each other about a front jaw pivot axis. The release behavior of the front jaw members is based on the dimension of the prestress about which the front jaw is prestressed by means of a tensioning member. This principle is equal to those of conventional ski bindings wherein the dimension of the prestress is defined in the form of a Z-value. Thereby, the tensioning member is chosen in a way that the Z-value can be adjusted continuously.

Each front jaw member guides a guiding arm and, thus, indirectly guides the position of the engagement members in a horizontal plane transverse to the longitudinal axis of the ski.

As the engagement members are disposed on the first end of the guiding arms opposing each other in the climbing position the front unit has a clamp-like or pliers-like effect by means of which the ski boot is supported.

Further, the front unit has a symmetrical structure, so that for example the right guiding arm or the right front jaw member forms a mirroring of the left guide arm or the left front jaw member on the middle plane of the ski which runs vertically through the middle axis of the ski. Thus, the front unit can be used both with a left and a right ski boot.

In a further preferred embodiment in the area of a second end each of the guiding arms are pivotably disposed about an axis vertically disposed to a shifting plane, wherein the second end of the guiding arms is supported rotatably about a pivot axis on a base plate of the front unit.

Thus, the guiding arms can be moved between the downhill position and the climbing position. Thereby, the movement of the guiding arms arises from the guidance of the front jaw members, by means of which the first ends of the guiding arms are moved towards each other or away from each other in order to lock or unlock a ski boot, respectively.

Compared to the first end of the guiding arms the second end of the guiding arms is closer to the tip of the ski. When the ski binding is switched from the downhill position to the climbing position the front jaw members move away from the first end of the guiding arms and move towards the second end of the guiding arms, whereby, each of the guiding arms is pivoted about its second end towards a middle axis of the ski. Thus, the distance between the engagement members on the first end of the guiding arms finally is reduced, so that they can be engaged with the ski boot.

If the binding is shifted from the climbing position to the downhill position, the front jaw members move away from the second end of the guiding arms towards the first end of the guiding arms. Thereby, the guiding arms undergo a pivoting about their second end away from the middle axis of the ski, whereby, the engagement members release the ski boot on the first end of the guiding arms.

In a further preferred embodiment the front jaw members each have a recess in which the engagement members are received in the downhill positon.

Thereby, it is possible that the front jaw members fixate the ski boot in the downhill position without being hindered by the engagement members. Accordingly, in the downhill position a fixation of the ski boot according to a conventional ski binding is possible by the front jaw.

In a further preferred embodiment a distance between the engagement members in the climbing position is smaller than a distance between the engagement members in the downhill position.

Due to the initially greater distance between the engagement members in the downhill position it is possible that the engagement members are lowered onto the ski boot when switching from the downhill position to the climbing position, and, thus, engage with the latter. In return, when switching from the climbing position to the downhill position the ski boot can be released from the engagement members by moving the engagement members apart from each other.

In a further preferred embodiment the engagement members are two pins opposing each other, which define the pivot axis, wherein the pins extend vertically from the guiding arms in a horizontal plane and in the climbing position each point towards a middle axis of the ski. The pins enable an easy rotation of the ski boot about the pivot axis. Therefore, solely two bore holes in the ski boot are required with which the pins can engage. The pivoting of the ski boot about the pivot axis defined by the pins eventually enables the walking function when the binding is in the climbing position.

In a further preferred embodiment the front jaw members each have a guidance for guiding of a guiding arm from the climbing position to the downhill position and vice versa.

By means of the guidance a contact between the front jaw members and the guiding arms is provided. Thus, the guidance acts as an interface for the transmission of force between a front jaw member and a guiding arm.

The geometry of the guidance in the contact area to the guiding arm is of the form of a negative of the profile of the guiding arm. Guiding arm and guidance are in proportion to each other, wherein the proportion has characteristics of a clearance fit or of a transition fit. Thereby, the surfaces of the guiding arm and of the guidance, which contact each other, have to be provided in a way so that they can slip down on top of one another.

The substantial contact areas of a guiding arm form the surface directed towards a vertical middle plane of the ski on the one hand and the surface averted from the vertical middle plane of the ski on the other hand. When the front jaw is moved from the climbing position to the downhill position or from the tip of the ski towards the end of the ski, a force from a front jaw member is applied to the surface of the guiding arm via the guidance, wherein the surface of the guiding arm is inclined towards the vertical middle plane of the ski. Thereby, the guiding arms are moved outward or away from the middle axis of the ski loosening the engagement members from the ski boot.

When the front jaw is moved from the downhill position to the climbing position or in the direction of the tip of the ski the force is applied from the front jaw member via the guidance to the surface of a guiding arm averted from the vertical middle plane of the ski. Thereby, the guiding arms are moved inwards or in the direction of the middle axis of the ski, thus, engaging the engagement members with the ski boot.

In a further preferred embodiment the front jaw is disposed on at least one guiding rail in order to provide the slideability of the front jaw relative to the engagement members. Thus, a fastening of the front jaw is provided which both can transmit high forces and is slideable in the longitudinal direction of the ski.

In a further preferred embodiment the front jaw is mounted to a slide which is slideably disposed on the at least one guiding rail.

In a further preferred embodiment the front jaw is adjustable via an operating lever in the direction of the longitudinal axis of the ski.

By means of the lever the front unit of the ski binding can be adjusted steplessly between a downhill position and a climbing position. Thereby, the operating lever in the climbing position or the downhill position is subjected to a prestress, which is provided by means of a tensioning device. Thereby, it is guaranteed that the operating lever stays in the climbing position or downhill position provided that no activation takes place.

The problem mentioned above is also solved by means of a system with the features according to claim 10. The dependent claims reveal advantageous embodiments.

Accordingly, a system is provided that comprises a front unit according to one of the claims aforementioned aspects and a rear unit for a ski binding which comprises a rear jaw in order to fixate the ski boot in a downhill position, wherein the rear unit is formed separate from the front unit.

Because the rear unit is not required for the pivotable support of the ski boot in the climbing position there is no need for a frame connection or a bridge connection between the front unit and the rear unit. Accordingly, compared to conventional systems which have front units and rear units that are also connected in the climbing position, a lower standing height and, thus, a better transmission of force onto the ski arises for the user.

In a further preferred embodiment the rear jaw is rotatable around a horizontal axis perpendicular to the longitudinal axis of the ski, in order to switch between a rear jaw position without a climbing aid and a rear jaw position with a first climbing aid.

In a further preferred embodiment the rear jaw has a second foldable climbing aid, wherein the rear jaw is switchable between the rear jaw position with the first climbing aid and a rear jaw position with a second climbing aid by folding the second climbing aid out or in.

By means of the multistage climbing aid the system is compatible with different climbing scenarios. In the climbing mode no fixation of the ski boot is provided by the rear unit. Rather, a heel portion of the ski boot can be put down on the first or the second climbing aid and can rest thereon freely.

BRIEF DESCRIPTION OF THE DRAWINGS

Preferred embodiments and aspects of the present invention are explained further by means of the following description of the drawings.

DETAILED DESCRIPTION

Figure 1A:
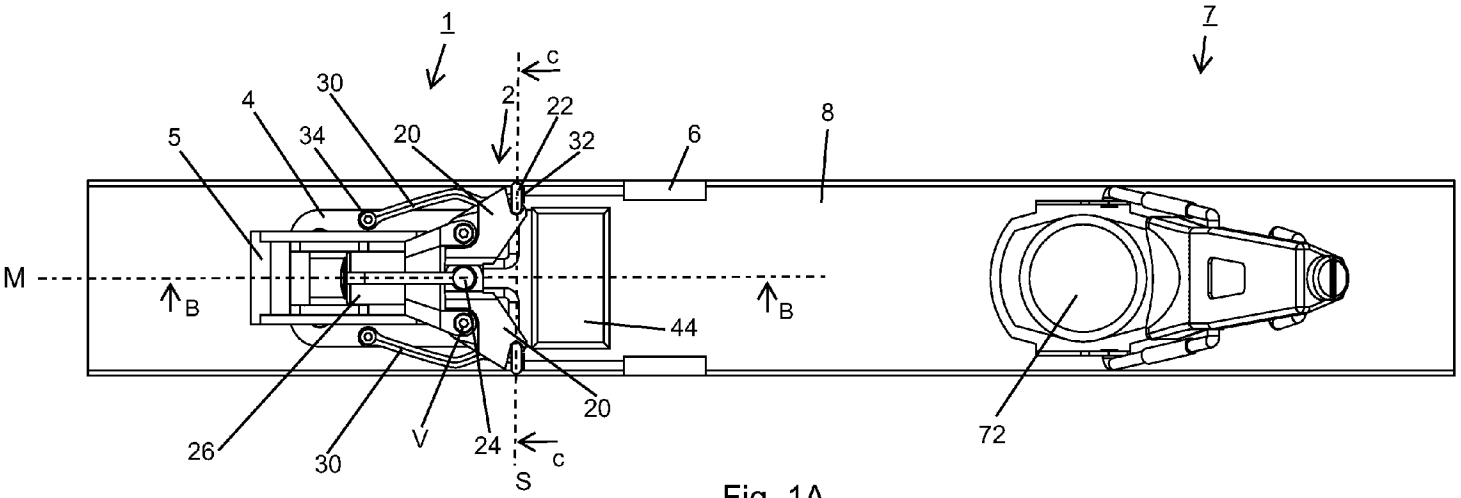
FIG. 1A schematically shows a top view of a front unit and a rear unit in the downhill position.

Hereafter preferred embodiments are described according to the figures. The same elements, similar elements or elements with the same effect are identified with the same reference signs. In order to avoid redundancies there is partially no repeated description of these elements in the following description.

FIGS. 1A to 1D show the section of ski 8 on which a front unit 1 and a rear unit 7 of a ski touring binding are disposed.

The front unit 1 is in the downhill position in which the front jaw 2 fixates a ski boot on the ski 8.

The front unit 1 has a base plate 4 on which the further components of the front unit are disposed. Thereby, the base plate 4 can be screwed or glued onto the ski 8. Possible materials for the base plate 4 are plastic materials such as fiber reinforced plastics, or metals such as magnesium, aluminum, steel and the like. On the base plate 4 a sliding plate 44 is attached onto which the ski boot can be set down and accordingly be shifted in the front unit until the ski boot is aligned in order to be fixated on the ski 8 by means of the front unit 1. Furthermore, the sliding plate 44 also serves the purpose that in case of a lateral release of the front unit 1, i.e. when the front unit 1 releases the ski boot due to an increased emergence of force, which exceeds a defined Z-value, the ski boot can slide over the sliding plate 44 towards one of the sides of the ski 8.

The front unit 1 further comprises a front jaw 2, which substantially contributes to the fixation of the ski boot on the ski 8. The front jaw 2 is formed symmetrically and comprises a left front jaw member 20 and a right front jaw member 20. The front jaw member 20 can be pivoted about a front jaw member pivot axis V. Additionally, the front jaw member 20 is held by a front jaw stick 24. The force that is necessary to pivot the front jaw member 20 about the front jaw member pivot axis V depends on the prestress of the front jaw stick 24. Accordingly, the front jaw stick 24 can be prestressed via a tensioning member 26. The value about which the front jaw stick 24 is prestressed via the tensioning member 26 is indicated as Z-value and defines the release behavior of a front jaw member 20 and, thus, the release behavior of the front jaw 2.

Furthermore, two guiding arms 30 are disposed symmetrically to the middle axis M of the ski on the base plate 4. A guiding arm 30 is rotatably supported at a second end 34 on the base plate 4. The guiding arm 30 extends from its second end 34 in the direction of a ski end towards the second end 32.

The guiding arm 30 runs through a guidance 22 of the front jaw 20. It can be taken from FIG. 1D that the outer side of the guiding arm 30 and the inner side of the guiding arm 30 can contact the guidance 22 and the front jaw member 20, respectively. In order to shift the front jaw member 20 together with the guidance 22 relatively to the guiding arm 30 between the downhill position and the climbing position, the guiding arm 30 is fitted between the front jaw member 20 and the guidance 22 with a little bit of clearance. Alternatively, the guiding arm can be fitted between the front jaw member 20 and the guidance 22 similar to a transition fit.

In the downhill position shown in FIG. 1A the guiding arm 30 has no load bearing function. By means of the pivotable support at the second end 34 on the base plate 4 the guiding arm 30 can follow pivoting movements of the front jaw member 20 in case of a lateral release of the ski boot out of the front unit.

Figure 1B:
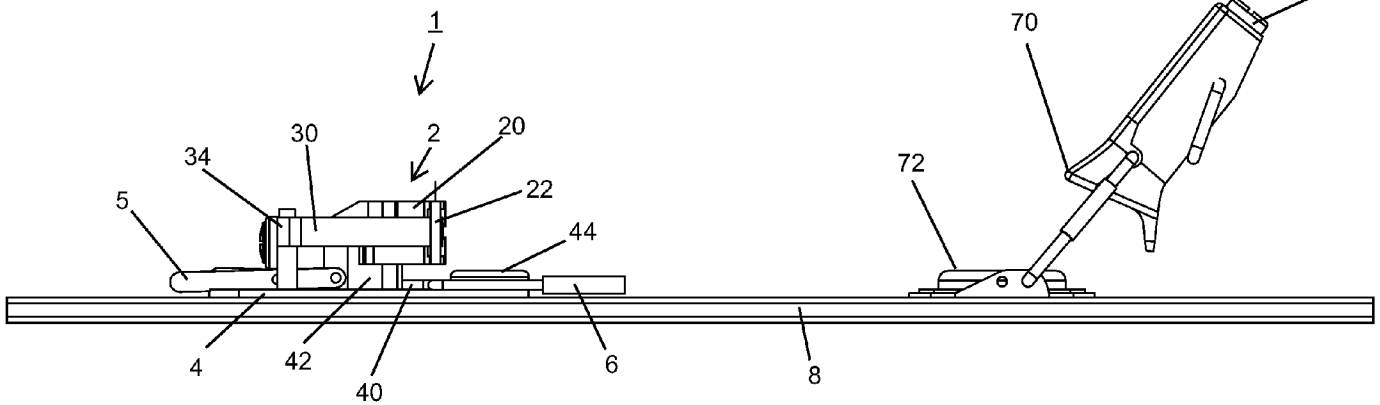
FIG. 1B schematically shows a side view of the front unit and the rear unit of the previous figure.
Figure 1C:
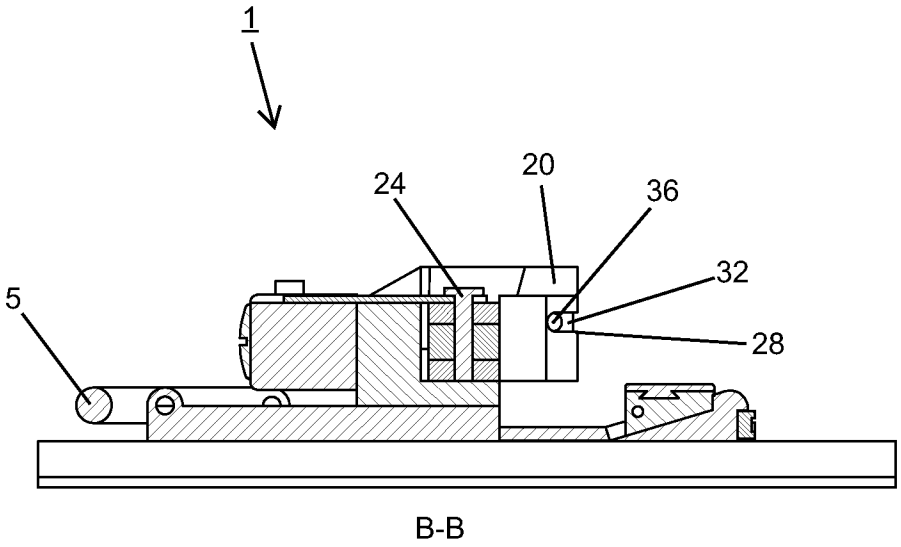
FIG. 1C schematically shows a sectional view of the front unit of the previous figures along cutting line B-B shown in FIG. 1A.
Figure 1D:
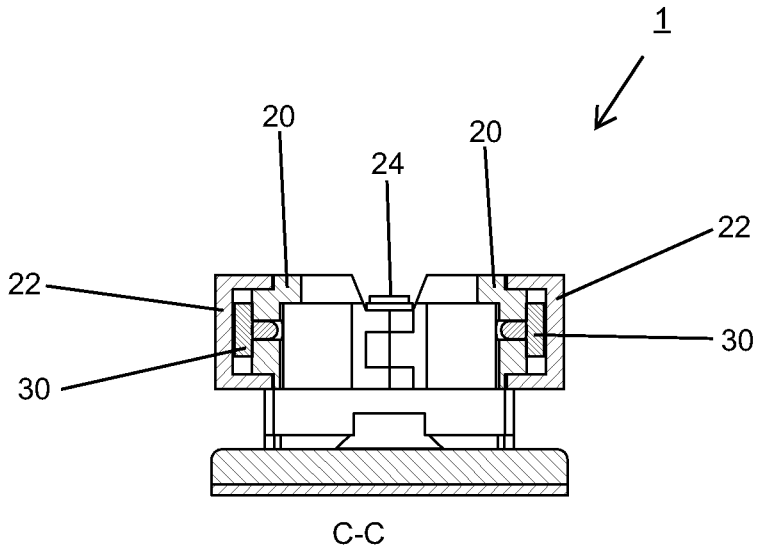
FIG. 1D schematically shows a sectional view of the front unit of the previous figures along cutting line C-C shown in FIG. 1A.

It can be taken from FIG. 1C that on the first end 32 of the guiding arm an engagement member 36 is disposed which serves to lock the ski boot in the climbing position. In the downhill position of the front unit 1 shown in FIG. 1C the engagement member is not in contact with the ski boot. Therefore, a recess 28 is provided in the front jaw 20, which receives the engagement member in the downhill position and thus prevents contact between the engagement member and the ski boot.

The guiding arm is made of plastic in particular a fiber reinforced plastic, or metal such as aluminum, magnesium, steel and the like. Also the front jaw members are made of plastic in particular a fiber reinforced plastic, or metal such as aluminum, magnesium, steel and the like.

In order to switch the front unit between the downhill position and the climbing position the front unit comprises an operating lever 5. As shown in FIGS. 1A and 1B the operating lever 5 is positioned almost parallel to a longitudinal axis of the ski 8 in the downhill position. In the downhill position a prestress is applied to the operating lever 5, which keeps the operating lever 5 and, thus, the front unit 1 in the downhill position. Accordingly, the operating lever 5 is in a snapped position by means of which it shall be prevented that the front unit unintentionally loosens itself out of the downhill position, for example due to forces applied on the ski during the downhill run. This can be achieved by means of a grid position in the base plate or by means of a spring mechanism. Alternatively, the operating lever 5 can also be implemented without being prestressed or snapped in the downhill position, as the operating lever 5 has exceeded a dead center of the lever mechanism in the downhill position.

The operating lever 5 is made of aluminum. Alternatively, it can be made of plastic in particular a fiber reinforced plastic, or other metals, such as magnesium, steel and the like.

The front unit 1 further comprises a stopper 6 which serves to slow down the ski when the ski loosens itself from the ski boot and slides downhill. The stopper 6 is formed in a way that it runs substantially parallel to the longitudinal direction of the ski when a ski boot is in the predetermined contact with the front unit 1. However, if the ski boot loosens from the front jaw 2 or is lifted from the sliding plate 44 the stopper 6 laterally can flap away downwards so that free ends of the stopper 6 can contact the surface of the slope.

FIG. 1B shows a rail 40 which is disposed on the base plate 4 in the longitudinal direction of the ski. On the rail 40 sits a slide 42, which carries the front jaw 2. In order to switch the front unit 1 from the downhill position shown in FIG. 1B to the climbing position shown in FIG. 2A the slide 42 and, thus, the front jaw 2 can be shifted on the rail 40 in the longitudinal direction of the ski towards the tip of the ski.

The rail 40 is made of aluminum. Alternatively, it can be made of plastic in particular a fiber reinforced plastic, or other metals, such as magnesium, steel and the like.

Moreover, FIGS. 1A and 1B show a rear unit 7, which comprises a rear jaw 70 for fixating the ski boot in the downhill position. In particular, the rear unit 7 comprises a sliding plate 72 on which a rear portion of the ski boot can be placed. The rear jaw 70 fixates the ski boot in the rear unit and presses the ski boot onto the sliding plate 72. The rear jaw 70 comprises a tensioning member 74 by means of which the contact pressure with which the rear jaw 70 presses the ski boot onto the sliding plate 72 can be adjusted.

Figure 2A:
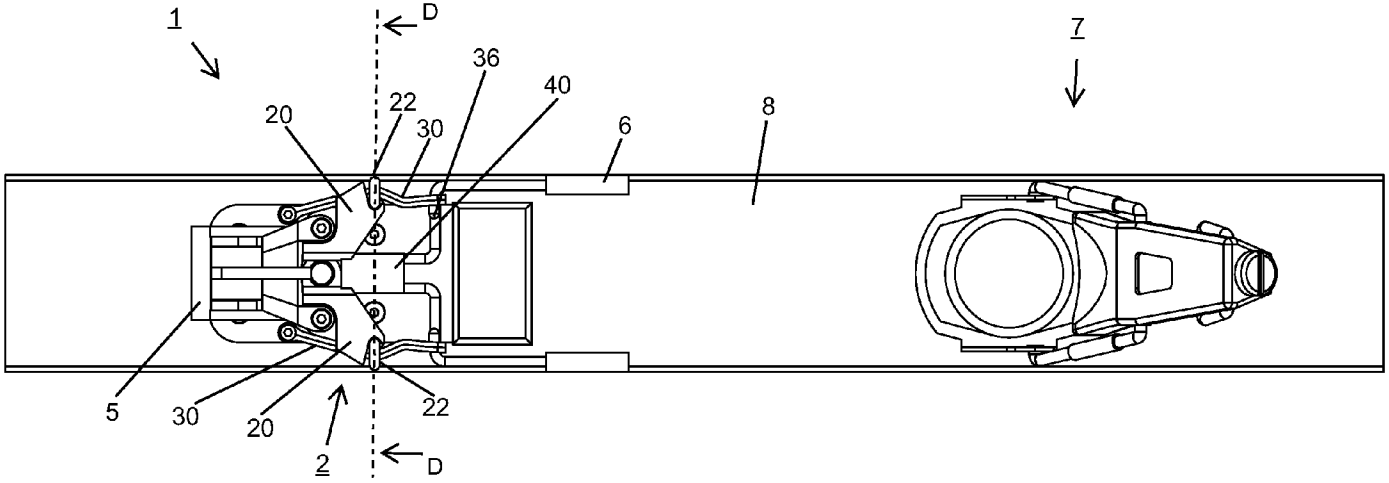
FIG. 2A schematically shows a top view of the front unit and the rear unit of the previous figures in a climbing position.
Figure 2B:
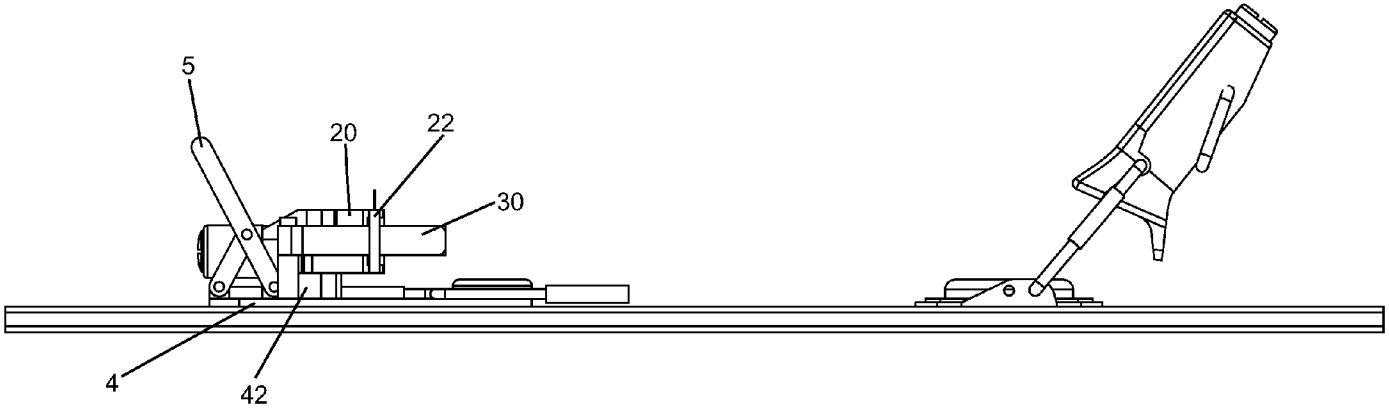
FIG. 2B schematically shows a side view of the front unit and the rear unit of the previous figures in the climbing position.
Figure 2C:
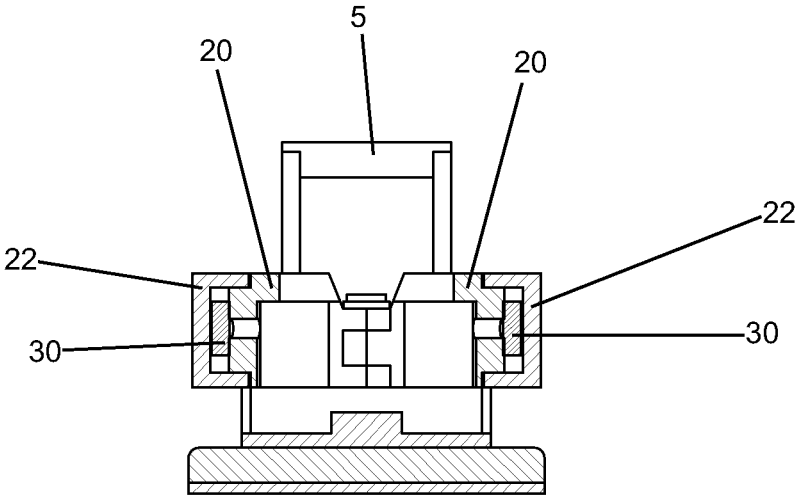
FIG. 2C schematically shows a sectional view of the front unit of the previous figures along the cutting line D-D shown in FIG. 2A.

FIGS. 2A and 2B show the front unit 1 in the climbing position. Compared to the downhill position the front jaw 2 is closer to the tip of the ski. With respect to the guiding arm 30 the front jaw member 20 is closer to the second end 34 of the guiding arm 30 compared to the downhill position. The first end 32 of the guiding arm 30 stands freely in the climbing position and is not covered by the front jaw member 20 or the guidance 22 as shown in FIG. 1A. On the free end 32 of the guiding arm 30 an engagement member 36 is provided, which extends from the guiding arm 30 towards the ski middle axis M. The engagement member 36 has the form of a pin and serves to engage with a bore hole provided in the ski boot. Due to the symmetrically opposing arrangement of two engagement members 36 the ski boot is locked in the climbing position. The pin type engagement members 36 enable a pivotable support of the ski boot about a horizontal pivot axis S perpendicular to the longitudinal axis of the ski.

As shown in FIG. 2B the operating lever 5 is in an upright position in the climbing position. In this position the operating lever 5 is snapped to ensure that the front unit 1 is kept in the climbing position. This is enabled by a grid position in the base plate 4. Alternatively, the operating lever can be kept in the climbing position also by means of a spring.

Compared to the downhill position the first end 32 of the guiding arm 30 is closer to the ski middle axis M in the climbing position.

Between the engagement member 36 and the front jaw member 20 there is a flow of forces which is provided via the guiding arm 30 and the guidance 22. Thereby, in the climbing position the guiding arm 30 contacts the guidance 22 as shown in FIG. 2B. Thus, also in the climbing position, in which the engagement member 36 is in contact with the ski boot, the tensioning member 26 can enable an actuation depending on the Z-value and, thus, a release of the ski boot.

If in the climbing position a ski boot is engaged with the engagement members 36 the stopper 6 is kept in a position parallel to the longitudinal axis of the ski as shown in FIG. 2B. If in the climbing position no ski boot is engaged with the engagement members 36 the stoppers 6 releases and laterally protrudes downwards in the direction of the surface of the slope.

In FIGS. 2A and 2B the ski boot is positioned by the engagement with the engagement members 36 with respect to the longitudinal axis of the ski in a way that the ski boot just no longer contacts the rear jaw 70 of the rear unit 7. Thus, the rear portion of the ski boot in the climbing position can be lifted from the sliding plate 72 and lowered onto the latter.

Figure 3A:
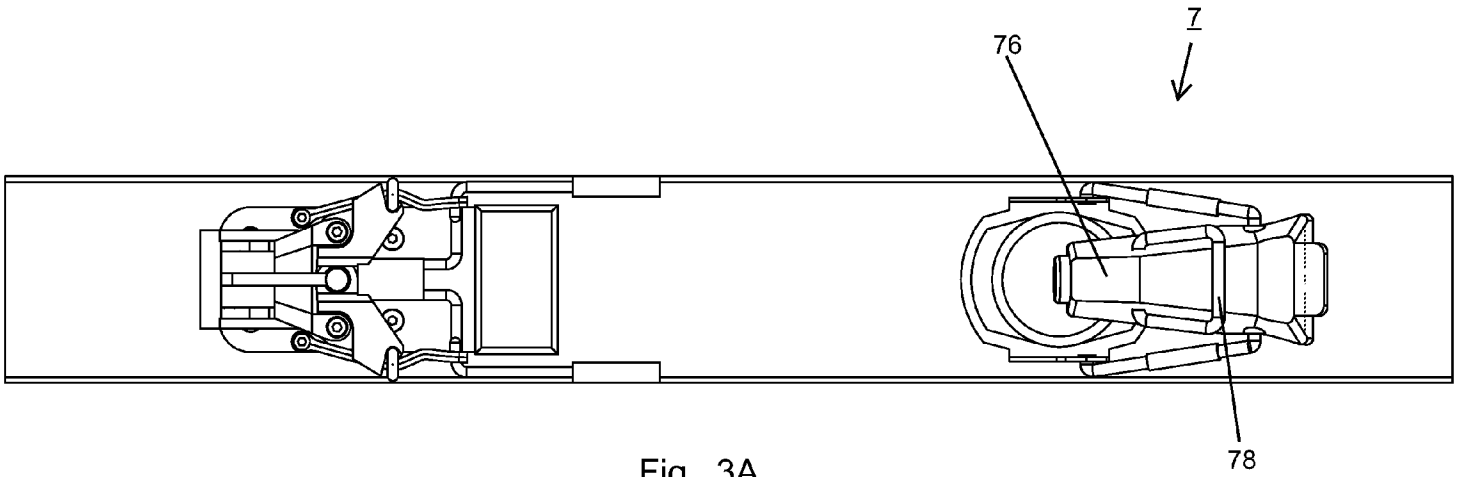
FIG. 3A schematically shows a top view of the front unit and the rear unit of the previous figures in the climbing position, wherein the rear unit forms a first climbing aid.
Figure 3B:
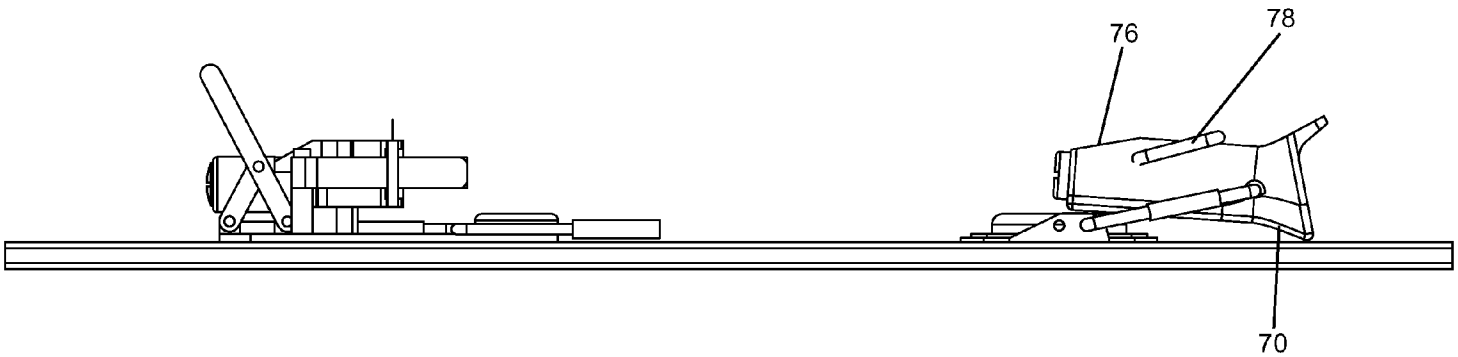
FIG. 3B schematically shows a side view of the front unit and the rear unit of the previous figures in the climbing position, wherein the rear unit provides a first climbing aid.

FIGS. 3A and 3B show the front unit 1 and the rear unit 7 in the climbing position, wherein the rear unit 7 provides a first climbing aid 76. The first climbing aid 76 is provided by turning the rear jaw around compared to the climbing position of the rear unit 7 without a climbing aid as shown in FIGS. 2A and 2B. Therefore, the rear jaw is pivotably supported about a horizontal axis perpendicular to the longitudinal axis of the ski. In the rear jaw position with the first climbing aid 76 the rear jaw 7 rests on the ski 8 and the tensioning member 74 is directed towards the ski tip. In this position the rear portion of the ski boot can be set down onto the climbing aid 76 and can be lifted from the latter.

Figure 4A:
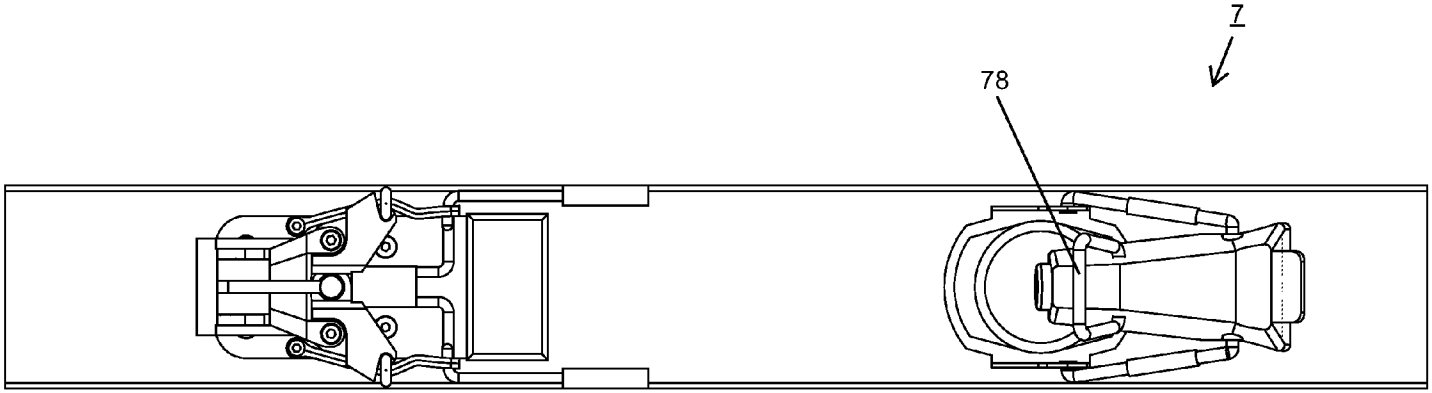
FIG. 4A schematically shows a top view of the front unit and the rear unit of the previous figures in a climbing position, wherein the rear unit provides a second climbing aid.
Figure 4B:
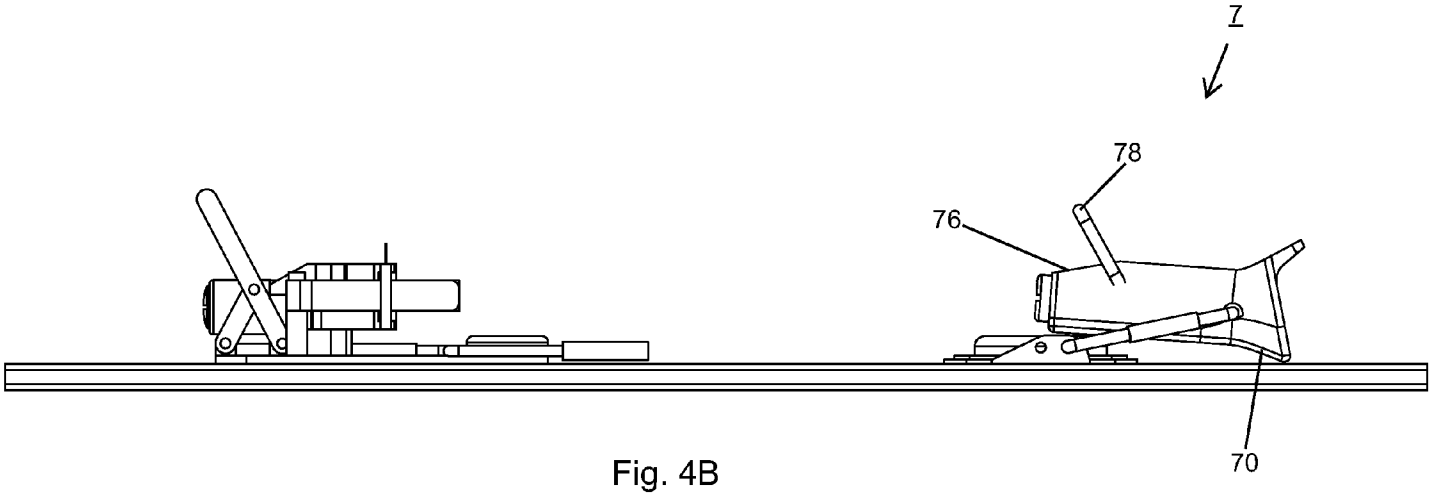
FIG. 4B schematically shows a side view of the front unit and the rear unit of the previous figures in the climbing position, wherein the rear unit provides a second climbing aid.

The FIGS. 4A and 4B show a front unit 1 and a rear unit 7 in the climbing position, wherein the rear unit 7 is in a position which provides a second climbing aid 78. The second climbing aid 78 is formed by a bracket which is disposed pivotable about a horizontal axis perpendicular to the longitudinal direction of the ski on the rear jaw 70. In the position of the rear jaw 70 shown in FIGS. 3A and 3B the second climbing aid 78 rests on the rear jaw 70. In the FIGS. 4A and 4B the second climbing aid 78 is folded out and protrudes from the rear jaw 70. The second climbing aid 78 snaps in this position so that the rear portion of a ski boot can be lifted from the second climbing aid 78 and can be lowered on the latter and that the climbing aid 78 thereby maintains its position.

Possible materials for the rear unit 7 are plastics, fiber reinforced plastics, aluminum, magnesium, or stainless steels. Also various combinations of materials are possible.

As far as applicable all single features shown in the single embodiments can be combined with each other and/or replaced with each other without departing from the field of the invention.

REFERENCE SIGNS

1 Front unit
2 Front jaw
20 Front jaw member
22 Guidance
24 Front jaw stick
26 Tensioning member
28 Recess
30 Guiding arm
32 First end
34 Second end
36 Engagement member
4 Base plate
40 Rail
42 Slide
44 Sliding plate
5 Operating lever
6 Stopper
7 Rear unit
70 Rear jaw
72 Sliding plate
74 Tensioning member
76 First climbing aid
78 Second climbing aid
8 Ski
M Ski middle axis
S Pivot axis
V Front jaw member pivot axis

The invention claimed is:

1. Front unit for a ski binding, comprising a front jaw for fixating a ski boot in a downhill position and engagement members for pivotably supporting the ski boot about a horizontal pivot axis (S) perpendicular to a longitudinal axis of a ski in a climbing position, wherein the front jaw is disposed slidably in the direction of the longitudinal axis of the ski relative to the engagement members for switching between the downhill position and the climbing position, wherein the engagement members are each disposed on a first end of two opposing guiding arms which substantially extend in the direction of the longitudinal axis of the ski and each are guided by a front jaw member of the front jaw.

2. A front unit according to claim 1, comprising the guiding arms in the area of a second end each are disposed pivotably about a pivot axis disposed perpendicular to a shifting plane, wherein the second end of the guiding arms is rotatably supported about the pivot axis on a base plate of the front unit.

3. A front unit according to claim 1, comprising the front jaw members each comprise a recess in which the engagement members are received in the downhill position.

4. A front unit according to claim 1, comprising a distance between the engagement members in the climbing position is smaller than a distance between the engagement members in the downhill position.

5. A front unit according to claim 1, comprising the engagement members are two pins opposing each other, which define the pivot axis S, wherein the pins extend vertically from the guiding arms in a horizontal plane, and in the climbing position each point towards a ski middle axis (M).

6. A front unit according to claim 1, comprising the front jaw members each comprise a guidance for guiding a guiding arm from the climbing position to the downhill position and vice versa.

7. A front unit according to claim 1, comprising the front jaw is disposed on at least one rail in order to provide the slidability of the front jaw relative to the engagement members.

8. A front unit according to claim 7, comprising the front jaw is mounted on a slide, which is slidably disposed on the at least one rail.

9. A front unit according to claim 1, comprising the front jaw is adjustable in the direction of the longitudinal axis of the ski via an operating lever.

10. System comprising, a front unit according to claim 1 and a rear unit for a ski binding, which comprises a rear jaw for fixating the ski boot in the downhill position, wherein the rear unit is formed separate from the front unit.

11. A system according to claim 10, comprising the rear jaw is rotatable about a horizontal axis perpendicular to the longitudinal direction of the ski, in order to switch between a rear jaw position without a climbing aid and a rear jaw position with a first climbing aid.

12. A system according to claim 11, comprising the rear jaw has a foldable second climbing aid, wherein by folding the second climbing aid out or in the rear jaw can be switched between the rear jaw position with the first climbing aid and the rear jaw position with the second climbing aid.

* * * * *